US006648992B2

(12) United States Patent
Jingu

(10) Patent No.: US 6,648,992 B2
(45) Date of Patent: Nov. 18, 2003

(54) HEAT TREATMENT METHODS FOR SLIDING BEARINGS MADE OF AGE-HARDENED ALUMINUM MATERIALS

(75) Inventor: Naoki Jingu, Isesaki (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 10/053,581

(22) Filed: Jan. 24, 2002

(65) Prior Publication Data

US 2002/0139452 A1 Oct. 3, 2002

(30) Foreign Application Priority Data

Feb. 13, 2001 (JP) ..... P2001-034760

(51) Int. Cl.[7] ..... C22F 1/04
(52) U.S. Cl. ..... 148/535; 148/537; 148/698
(58) Field of Search ..... 148/535, 537, 148/698

(56) References Cited

U.S. PATENT DOCUMENTS

| | | | | |
|---|---|---|---|---|
| 2,709,339 A | | 5/1955 | Edelman et al. | |
| 4,037,522 A | | 7/1977 | Inoshita et al. | |
| 4,244,679 A | | 1/1981 | Nakayama et al. | |
| 4,664,604 A | | 5/1987 | Terauchi | |
| 5,056,417 A | | 10/1991 | Kato et al. | |
| 5,382,139 A | | 1/1995 | Kawaguchi et al. | |
| 5,614,037 A | * | 3/1997 | Keener | 148/537 |
| 5,858,133 A | * | 1/1999 | Keener | 148/537 |
| 5,875,702 A | | 3/1999 | Kawagoe et al. | |
| 5,974,946 A | | 11/1999 | Kanou et al. | |
| 6,457,399 B1 | * | 10/2002 | Jingu | 92/71 |

FOREIGN PATENT DOCUMENTS

| | | |
|---|---|---|
| JP | 57-028881 | 2/1982 |
| JP | 2-267371 | 11/1990 |
| JP | 3-067069 | 3/1991 |
| JP | 8-247021 | 9/1996 |

* cited by examiner

*Primary Examiner*—George Wyszomierski
(74) *Attorney, Agent, or Firm*—Baker Botts L.L.P.

(57) ABSTRACT

A heat treatment method for sliding bearings made of age-hardened aluminum materials includes an aluminum material that is artificially age-hardened for a time that is less than the time specified for reaching a maximum hardness, and a coating of a thermoplastic resin, or a solid lubrication material including a thermoplastic resin as a binder. The coating is placed on a surface of the aluminum material and is calcined.

5 Claims, 1 Drawing Sheet

HEAT TREATMENT METHODS FOR SLIDING BEARINGS MADE OF AGE-HARDENED ALUMINUM MATERIALS

BACKGROUND OF THE INVENTION

1. Field of the Invention

The present invention relates to heat treatment methods for sliding bearings made of age-hardened aluminum materials, or the like, and more particularly, to heat treatment methods for sliding bearings used in swash plate-type compressors.

2. Description of Related Art

Age-hardened aluminum materials, e.g., artificially age-hardened aluminum alloys, may be used in the manufacture of components of swash plate-type compressors, e.g., pistons, swash plates, or the like, to produce components of sufficient hardness, but lighter weight than components made of other metals, e.g., ferrous metals, such as steel, or the like. The age-hardened aluminum materials may be coated with a thermoplastic resin, or a solid lubrication material that may include a thermoplastic resin as a binder, to form sliding bearings, e.g., sliding bearing portions of pistons, swash plates, or the like. Moreover, the thermoplastic resin, or the solid lubrication material comprising a thermoplastic resin as a binder, may be calcined. The calcination temperature of the thermoplastic resin, or the solid lubrication material comprising a thermoplastic resin as a binder, is substantially the same as the age-hardening temperature of the aluminum materials, e.g., age-hardened aluminum alloys. As a result, the age-hardened aluminum materials may experience a decrease in hardness from overaging due to the calcination treatment.

SUMMARY OF THE INVENTION

A need has arisen to provide a heat treatment method for sliding bearings made of age-hardened aluminum materials, which method reduces or eliminates overaging of the age-hardened aluminum materials.

In an embodiment of the present invention, a heat-treated sliding bearing made of an age-hardened aluminum material comprises an aluminum material, wherein the aluminum material is artificially age-hardened for a time that is less than a time specified for reaching a maximum hardness. Moreover, a coating of a thermoplastic resin is placed on a surface of the aluminum material and the coating is calcined.

In further embodiment of the present invention, a heat-treated sliding bearing made of an age-hardened aluminum material comprises an aluminum material, wherein the aluminum material is artificially age-hardened for a time that is less than a time specified for reaching a maximum hardness. Moreover, a coating of a solid lubrication material comprising a thermoplastic resin as a binder is placed on a surface of the aluminum material, and the coating is calcined.

In a still further embodiment of the present invention, a method of heat treating sliding bearings made of an age-hardened aluminum material comprises the steps of age-hardening an aluminum material for a time that is less than the time specified for reaching a maximum hardness of the aluminum material, coating the aluminum material with a substance, and calcining the substance. The substance may comprise a thermoplastic resin, or a solid lubrication material comprising a thermoplastic resin as a binder. Moreover, a heat-treated sliding bearing made according to this method, is disclosed in yet another embodiment of the present invention.

Other objects, features, and advantages of this invention will be apparent to, and understood by, persons of ordinary skill in the art from the following description of preferred embodiments with reference to the accompanying drawing.

BRIEF DESCRIPTION OF THE DRAWING

The present invention may be more readily understood with reference to the following drawing.

DETAILED DESCRIPTION OF PREFERRED EMBODIMENTS

Figure 1:
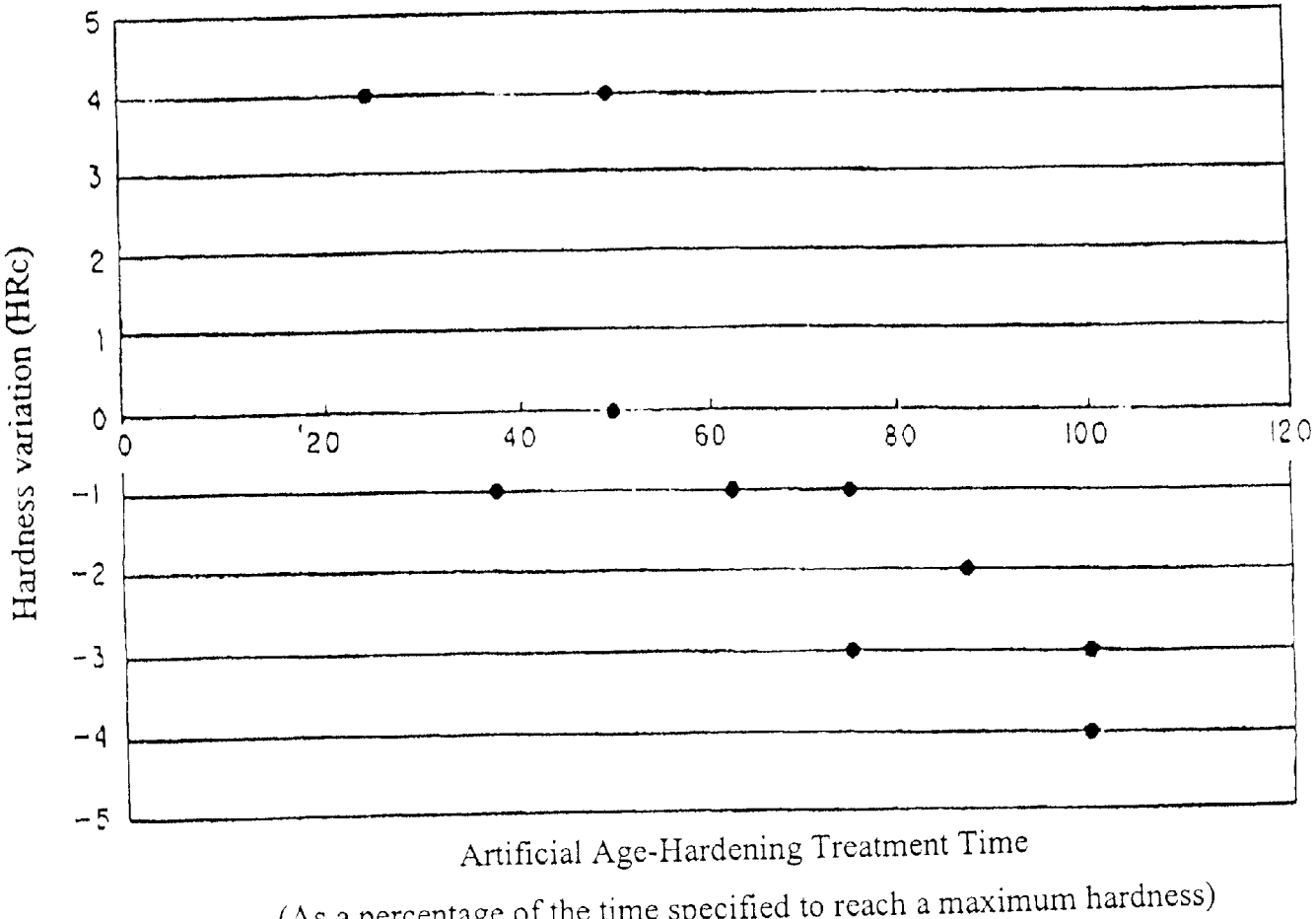
FIG. 1 shows a correlation diagram of the relationship between an artificial age-hardening treatment time and a hardness variation of an age-hardened aluminum material.

According to the present invention, an aluminum material, e.g., an aluminum alloy, may be used in the manufacture of swash plate-type compressor components, e.g., swash plates, pistons, or the like. The aluminum material may be subjected to a solution hardening treatment, e.g., at a temperature specified by a manufacturer of the aluminum material. Moreover, the aluminum material may be subjected to age-hardening treatment, e.g., artificial age-hardening treatment. Further, the aluminum material may be coated with a thermoplastic resin, or a solid lubrication material that may include a thermoplastic resin as a binder. The coating may be subjected to calcination treatment, which occurs at a temperature that is substantially similar to the artificial age-hardening treatment temperature of the aluminum material.

To reduce or eliminate overaging of the aluminum material, e.g., artificial age-hardening of the aluminum material beyond a point at which a maximum, e.g., a peak, hardness of the aluminum material is reached, and beyond which point the hardness of the aluminum material decreases, the method according to the present invention artificially age-hardens the aluminum material for a treatment time that is less than the time specified to reach the maximum hardness of the aluminum material, e.g., a treatment time specified by a manufacturer of the aluminum material to reach a maximum hardness of the aluminum material. It has been found that by subjecting the aluminum alloy material to an artificial age-hardening treatment time that is a percentage of the time specified to reach a maximum hardness of the material, e.g., 75% of the specified time, or the like, any loss of aluminum material hardness due to calcination treatment is reduced or effectively eliminated. Moreover, it has been found that by subjecting the aluminum material to an artificial age-hardening treatment time that is too short, e.g., less than 25% of the time specified to reach a maximum hardness of the aluminum material, the aluminum material may not be hardened sufficiently for use in the manufacture of swash plate-type compressor components, e.g., pistons, swash plates, or the like, even though the aluminum material may be subjected to calcination treatment. Therefore, according to the present invention, overaging of an artificially-aged aluminum material may be reduced or eliminated by subjecting the aluminum material to artificial age-hardening for a period of time that is less than the time specified to reach a maximum hardness of the aluminum material, e.g., 75% of the specified time, but greater than a time required to harden the aluminum material enough for use in the manufacture of swash plate-type compressor components, e.g., 25% of the specified time.

The invention will be further clarified by a consideration of the following example, which is intended to be purely exemplary of the use of the invention. The heat treatment method according to the present invention was tested using an aluminum material, e.g., an aluminum alloy expanded material, such as that defined by Japanese Industrial Standards Code (JIS) 4032, prepared according to the following procedure. The aluminum material was subjected to solution hardening treatment at a temperature specified by the manufacturer of the aluminum material. Further, the aluminum alloy material was subjected to artificial age-hardening treatment at a temperature specified by the manufacturer of the aluminum material. Moreover, the artificial age-hardening treatment was conducted for different periods of time, ranging from about 25% of the manufacturer's specified time to reach a maximum hardness of the aluminum material to about 100% of the manufacturer's specified time to reach a maximum hardness of the aluminum material. In this case, the manufacturer specified that artificial age-hardening should be conducted for about eight (8) hours to harden the aluminum material to a maximum hardness. Moreover, the aluminum material was coated with a substance, e.g., a thermoplastic resin, a solid lubrication material comprising a thermoplastic resin as a binder, or the like. Thereafter, the coated aluminum material was subjected to calcination treatment.

The parameters for the foregoing tests are disclosed in the following table:

| | Temperature | Time |
|---|---|---|
| Solution Hardening | 495° C. | |
| Artificial Age-hardening | 180° C. | (0.25 – 1.2) × 8 hours |
| Calcination Temperature | 185° C. | 2 hours |

FIG. 1 depicts a correlation diagram showing the relationship between an artificial age-hardening treatment time of an age-hardened aluminum material, i.e., JIS 4032, and a hardness variation of the age-hardened aluminum material according to the heat treatment method of the present invention. The artificial age-hardening treatment time is given as a percentage of the treatment time specified by the manufacturer to reach a maximum hardness. The hardness variation measures a variation between a hardness of the aluminum material at the termination of calcination treatment and a hardness of the aluminum material at the termination of artificial age-hardening treatment.

As shown in FIG. 1, when the artificial age-hardening treatment time was less than 75% of the treatment time specified to reach a maximum hardness of the aluminum material, the hardness variation was reduced compared to those instances in which the artificial age-hardening treatment time exceeded 75% of the specified treatment time. When the artificial age-hardening treatment time was less than 25% of the treatment time specified by the manufacturer of the aluminum material to reach a maximum hardness, an adequate hardness was not achieved, even though the aluminum material was subjected to calcination treatment, in addition to artificial age-hardening treatment. According to the above-described results, any overaging of the aluminum material, and a corresponding decrease of the hardness of the age-hardened aluminum material, may be reduced or effectively eliminated by artificially age-hardening an aluminum material for no less than 25%, and no more than 75%, of the time specified for the aluminum material to reach its maximum hardness.

According to an Aluminum Hand Book published by the Japanese Aluminum Association, artificial age-hardening treatment conditions, e.g., temperature, time, or the like, are substantially the same among age-hardened aluminum materials, e.g., JIS 2000 series, JIS 7000 series, or the like. Accordingly, the proposed heat treatment method of the present invention may be applied to age-hardened aluminum materials besides an aluminum alloy expanded material, such as JIS 4032.

According to the present invention, a sliding bearing may be made of an age-hardened aluminum material, e.g., an aluminum alloy. The aluminum material is artificially age-hardened for a treatment time that is less than the time specified for reaching a maximum hardness for the aluminum material. Moreover, the aluminum material may be coated with a substance. Further, the substance may be calcined. The substance may comprise a thermoplastic resin, or a solid lubrication material comprising a thermoplastic resin as a binder.

Thus, according to the heat treatment method of the present invention, if the artificial age-hardening time is set at an appropriate percentage of the time specified to reach a maximum hardness of the age-hardened aluminum material, overaging of the aluminum material may be effectively reduced or eliminated.

Although the present invention has been described in connection with preferred embodiments, the invention is not limited thereto. It is intended that the specification and examples be considered as exemplary only, with the true scope and spirit of the invention being indicated by the following claims. It will be understood by those skilled in the art that other embodiments, variations and modifications will be apparent to those skilled in the art from a consideration of this specification or practice of the invention disclosed herein, and may be made within the scope and spirit of this invention, as defined by the following claims.

What is claimed is:

1. A method of heat treating sliding bearings made of an age-hardened aluminum material comprising the steps of:

artificially age-hardening an aluminum material for a time that is less than a time specified for reaching a maximum hardness of said aluminum material;

coating said aluminum material with a substance after artificially age-hardening said aluminum material; and calcining said substance after coating said aluminum material with said substance.

2. The method of claim 1, wherein said substance is a thermoplastic resin.

3. The method of claim 1, wherein said substance is a solid lubrication material comprising a thermoplastic resin as a binder.

4. The method of claim 1, wherein said age-hardening time is less than 75% of said time specified for reaching a maximum hardness.

5. The method of claim 1, wherein said age-hardening time is more than 25% of said time specified for reaching a maximum hardness.

* * * * *